US005176527A

United States Patent [19]

Herbert

[11] Patent Number: 5,176,527

[45] Date of Patent: Jan. 5, 1993

[54] APPARATUS FOR PREVENTING THE USE OF AN ELECTRICAL DEVICE

[75] Inventor: Gilles J. Herbert, Waltham, Mass.

[73] Assignee: E. I. Du Pont de Nemours and Company, Wilmington, Del.

[21] Appl. No.: 629,662

[22] Filed: Dec. 14, 1990

[51] Int. Cl.[5] ..... H01R 13/44

[52] U.S. Cl. ..... 439/134; 439/133; 439/367

[58] Field of Search ..... 439/133, 134, 149, 304, 439/306, 367

[56] References Cited

U.S. PATENT DOCUMENTS

| | | | |
|---|---|---|---|
| 2,654,073 | 9/1953 | Katz | 439/134 |
| 2,664,734 | 1/1954 | McEneaney | 70/57 |
| 2,733,416 | 1/1956 | Evalt | 339/37 |
| 2,978,613 | 4/1961 | Hein | 439/133 |
| 3,345,600 | 10/1967 | Scherer | 439/134 |
| 3,416,123 | 12/1968 | Husebo | 439/134 |
| 3,422,389 | 1/1969 | Husebo | 439/134 |
| 3,543,544 | 12/1970 | Efston | 70/57 |
| 4,025,140 | 5/1977 | Matys | 439/134 |
| 4,445,738 | 5/1984 | Wiencke | 339/37 |
| 4,566,297 | 1/1986 | Hawley | 70/87 |

*Primary Examiner*—Paula A. Bradley

[57] ABSTRACT

A lockout apparatus for preventing the use of an electrical device is characterized by a body having at least a first channel sized to receive a projecting portion of the electrical apparatus. A bore intersects the first channel and has a locking pin threadably displaceable therein. The locking pin is engagable in securing contact with the projecting portion of the electrical device receiveable within the channel. The body further includes a second bore intersecting the first bore, the second bore being sized for receipt of a member that prevents access to the locking pin disposed in the first bore.

18 Claims, 3 Drawing Sheets

APPARATUS FOR PREVENTING THE USE OF AN ELECTRICAL DEVICE

BACKGROUND OF THE INVENTION

1. Field of the Invention

The present invention relates to an apparatus for preventing the unauthorized use of an electrical device.

2. Description of the Prior Art

The hazards attendant with the unauthorized or accidental use of hazardous electrical equipment have lead to the promulgation of Occupational Safety and Health Administration Regulations 29 C.F.R. Part 1910, Oct. 31, 1989. In general such regulations are designed to protect employees from the release of potentially hazardous energy while maintenance and/or servicing activities are being preformed. These regulations require employers to establish a program and to utilize procedures for affixing appropriate use prevention, or "lockout", apparatus on a piece of electrical equipment. The lockout apparatus serves to prevent the unauthorized or accidental operation, energization or start-up of the equipment. The lockout apparatus must be removed or disabled before operation of the electrical equipment can occur.

Presently, at least three classes of apparatus for preventing the unauthorized use of an electrical device are known in the art. One class of lockout apparatus is operable to prevent the connection of the power plug of the electrical device to an energy source. A second class of lockout apparatus is attachable to the actuating lever of a switch on the electrical device and, when so attached, is operable to impede the manipulation of the switch. A third class of lockout apparatus takes the form of a removable component of an switch which, if absent, prevents actuation of the electrical device.

Typically lockout apparatus of the first mentioned class is arranged so as to interact with the power blades of the power plug of the electrical device. When the use prevention apparatus is secured to the plug the insertion of the plug into a power outlet is prevented, thus precluding the use of the electrical device. Exemplary of such prior art apparatus are those disclosed in U.S. Pat. No. 3,543,544 (Efston), U.S. Pat. No. 2,654,073 (Katz), U.S. Pat. No. 4,025,140 (Matys), U.S. Pat. No. 4,445,738 (Wiencke), U.S. Pat. No. 4,566,297 (Hawley), U.S. Pat. No. 2,664,734 (McEneaney), and U.S. Pat. No. 2,733,416 (Evalt).

Lockout apparatus as exemplified by the above-mentioned patents usually include a body member, or block, having a passage formed therein which accepts one or both of the blades of the electrical plug. A gripping arrangement is disposed within the interior of the block. The gripping arrangement either acts against a surface on one or both of the blades and/or engages a feature thereon, such as an opening formed in a blade. This class of lockout apparatus includes a lock-key arrangement which would comply with the OSHA regulations. In general such lockout apparatus as exemplified by the referenced patents are generally mechanically complex in structure.

The second of the above-mentioned class of lockout apparatus is adapted for use with the operating lever found on circuit breaking equipment. Manipulation of the lever along an arcuate path changes the state of the switch from the "off" to the "on" position, and return. One example of such lockout apparatus is a clip sold by Crouse-Hinds Company, a division of Cooper Industries, Inc., Syracuse, N.Y. The clip is generally spoon-like in configuration having an elongated handle and a hollowed portion that is specifically sized to accept the operating lever of a circuit breaker available from a predetermined manufacturer. A web traverses the hollowed portion. A set screw extends through the web into the lever of the breaker, thereby securing the same to the web. The handle portion of the clip abuts against the face of the breaker, thus preventing rotation of the lever. The clip does not accept a lock and therefore would not appear to completely satisfy the OSHA regulations.

Another example of this class of lockout apparatus is a snap-on clip that sold as model BHLW by Bryant Electrical, Bridgeport, Conn., a division of Westinghouse Electric Corporation. This apparatus is a elongated generally C-shaped clip having cut-out regions respectively positioned to accept the operating lever of a breaker when the same is either in the "on" or the "off" position. The C-shaped clip snaps onto the housing of the breaker, with the lever projecting into one of the cut-outs therein. This clip is secured to the lever of a breaker with a set-screw.

In both of these last-mentioned examples of a lockout apparatus the securing mechanism the attaches the lockout apparatus to the breaker is not positively protected by a lock. Thus such apparatus are believed not capable of compliance with the OSHA regulations.

The third of the above-mentioned class of lockout apparatus has an integral switch with a removable operating handle. When assembled the handle is received in a correspondingly shaped recess provided in the switch. Insertion of the handle into the recess is essential before the equipment can be operated. Unless the shape of the handle and corresponding recess are unique or unusual such an apparatus is believed not capable of compliance with the OSHA regulations, inasmuch as a screwdriver or similar tool might disable the same.

In view of the foregoing it is believed advantageous to provide a lockout apparatus that prevents the use of an electrical device either by rendering the power plug incapable of insertion into an outlet and/or immobilizing the switching lever of a breaker. Further, it is believed advantageous to provide a lockout apparatus that is mechanically simple in construction and therefore economical to manufacture and use, yet at the same time accommodates a locking mechanism that must be positively removed before the electrical device may be used, thus rendering such a lockout apparatus able to comply with the OSHA regulations.

SUMMARY OF THE INVENTION

The present invention relates to an apparatus for preventing the use of an electrical apparatus. The apparatus, in a first embodiment, comprises a body having a surface thereon that includes at least a line of contact therein. The body has at least a first channel formed therein and a first bore extending therethrough. The channel may take the form of a trough-like opening. The bore intersects the channel. The channel is sized to receive a first projecting portion of an electrical device. Locking means is disposed within the bore and is advanceable therethrough into locking engagement with a projecting portion of an electrical device received within the channel. The locking means preferably takes the form of a threaded locking pin having a slot at one end thereof whereby an implement, as a screwdriver, may engage the locking pin and advance the same within the bore. Such an embodiment of the present invention is adapted for use with a plug of the type having at least one an arcuate power blade or with a switch having a movable actuating lever. The locking pin when advanced into the channel engages and firmly secures against the body the projecting portion of the electrical device that is received within the channel. In the event the electrical device is a switch when the pin is so engaged to the lever of the switch the line of contact of the abutment surface acts against the housing of the switch and thereby prevents movement of the actuating lever for that full range of arcuate motion necessary to change the state of the switch.

In a second embodiment the body has a second channel formed therein. The second channel, which may take the form of an enclosed passage, is spaced a predetermined distance from the first channel. The bore intersects both the first and the second channels. The second channel is sized to receive a second projecting portion of an electrical device. Such an embodiment of the present invention is primarily adapted for use with a plug of the type having a pair of power blades and a grounding blade. The power blades are receivable within the first channel while the grounding blade of the switch is receivable in the second channel. The locking means, preferably of the form discussed above, is advanced through the bore until the pin engages the grounding blade of the plug and secures the same against the body.

In either embodiment of the invention the body is further provided with a second bore that intersects the first bore. The second bore is sized to accept an access prevention member, such as the lockbar of a lock. When received in the second bore the lockbar serves to prevent access to the locking pin, thus precluding removal of the apparatus from the electrical device.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 3:
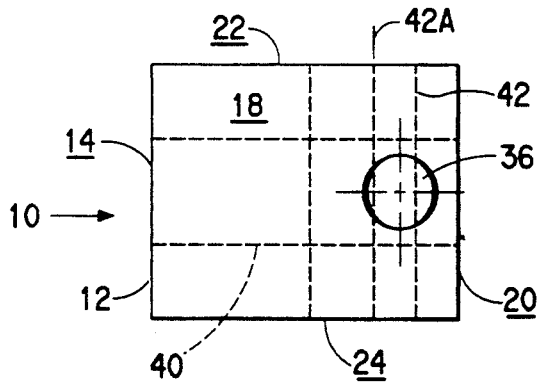
FIGS. 1, 2 and 3 are, respectively, a front elevational view, a side elevational view, and a top view of an apparatus in accordance with the present invention for preventing the use of an electrical device.
Figure 1:
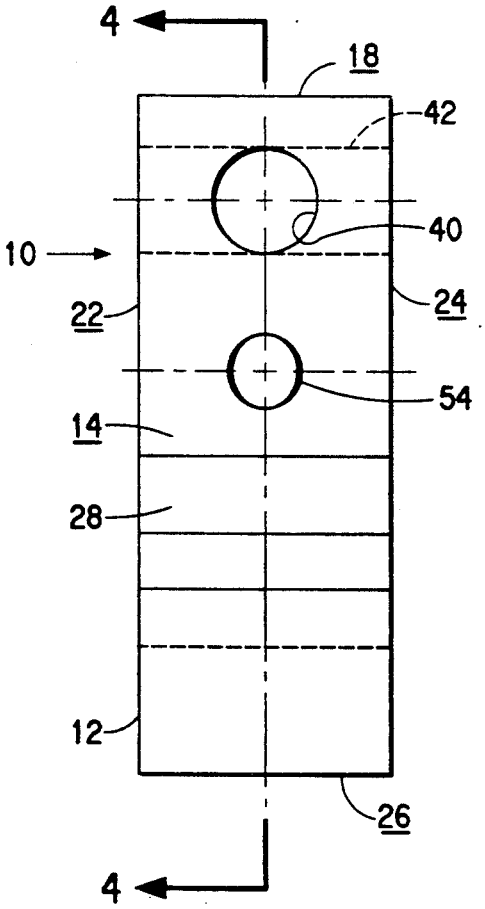
Figure 2:
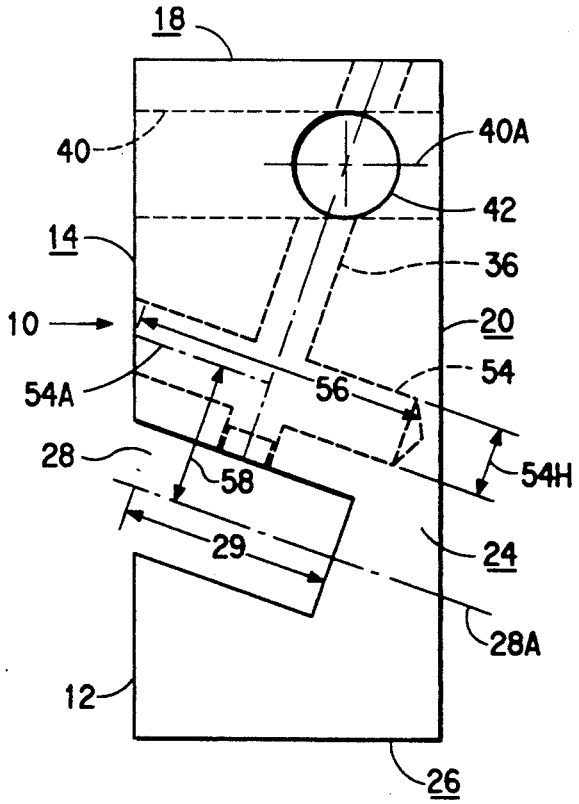

Throughout the following detailed description similar reference numerals refer to similar elements in all Figures of the drawings.

With reference to FIGS. 1 to 4 shown is an apparatus generally indicated by reference character 10 for preventing the use of an electrical device. The apparatus 10, which may hereinafter also be referred to as a "lockout" apparatus, comprises a block 12 formed of a rigid and preferably electrical nonconductive material. Suitable for use as the material for the lockout apparatus 10 is the engineering plastic sold by E. I. du Pont de Nemours and Company under the trademark "Delrin". The body 12 has at least a frontal abutment surface 14 containing at least a line of contact 16 therein. At least two other active surfaces, e.g., the surfaces 18, 20 are provided on the body 12. In the preferred case illustrated in the Figures the body 12 is rectanguloid in shape with the frontal abutment surface 14 being generally planar. The active surface 18 is planar and defines the top of the rectanguloid body 12. The second active surface 20 is also planar and defines the rear surface of the body 12. The body 12 also includes lateral, or side, surfaces 22, 24 and a bottom surface 26.

Figure 4:
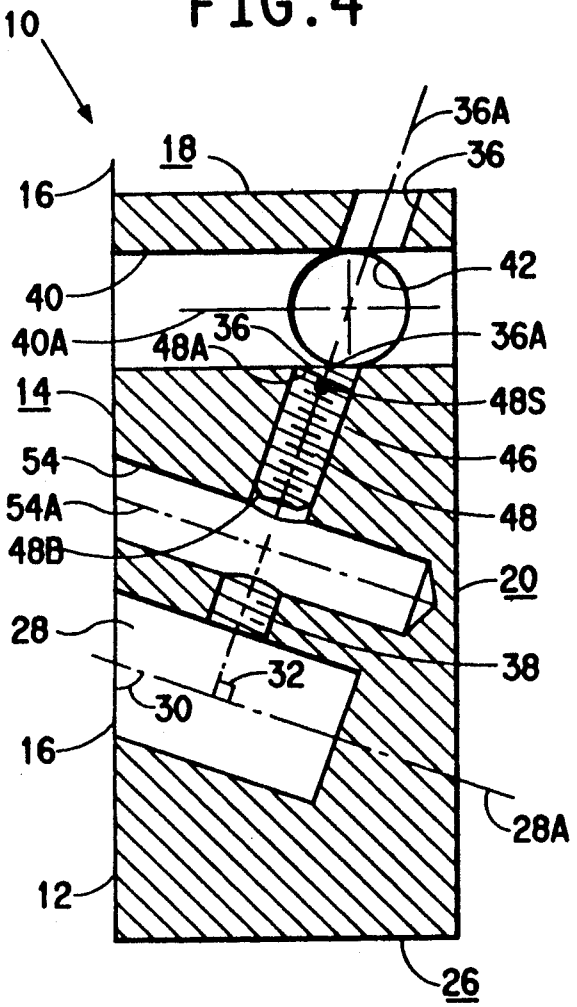
FIG. 4 is a side elevational view entirely in section taken along section lines 4—4 in FIG. 1.

The body 12 has a first channel 28, generally rectanguloid in shape, formed therein. The first channel 28 has an axis 28A associated therewith. The first channel 28 takes the form of a trough-like opening that opens onto the abutment surface 14 and extends a predetermined distance 29 (measured along the axis 28A) into the body 12. The first channel 28 also communicates with the lateral surfaces 22, 24, although it should be understood that the channel 28 need not be laterally open in this sense, but may be bounded by those lateral surfaces 22, 24. The axis 28A of the first channel 28 defines a predetermined angle 30 with respect to the abutment surface 14, and particularly to the line of contact 16 contained therein. The angle 30, measured as indicated in FIG. 4, is on the order of eighty degrees (80°). As will be developed the first channel 28 is sized to accept a first projecting portion of an electrical device whereby the lockout apparatus 10 may be secured thereto.

A first bore 36, generally circular in cross section, is formed in the body 12. The first bore 36 has an axis 36A associated therewith and extending therethrough. The first bore 36 opens on the second active surface 18 and extends through the body 12 into intersecting relationship and fluid communication with the first channel 28. The axis 36A of the first bore 36 preferably intersects the axis 28A of the first channel 28 at an angle 32, which in the preferred case is ninety degrees (90°). Preferably the first bore is threaded, as suggested at 38.

The body 12 is provided with a second bore 40 having an axis 40A extending therethrough. The second bore 40 intersects the first bore 36. Although the second bore 40 is shown in the Figures as extending between and opening onto the frontal abutment surface 14 and the second active surface 20 it should be understood that, in general, the second bore 40 may take any convenient path through the body 12, opening onto whatever surfaces of the body as are provided and taking any orientation therethrough, so long as the second bore 40 intersects the first bore 36. Thus, it should be apparent that if the rectanguloid form of the body 12 is used the second bore 40 may extend between the side surfaces 22, 24.

Further to this line of thought the body 12 may, if desired, further include a third bore 42 having an axis 42A associated therewith. The third bore 42, if provided, may be oriented in any convenient fashion within the body so long it also intersects the first bore 36. Preferably the third bore 42 should also intersect the second bore 40. Thus if the rectanguloid form of the body 12 is used the third bore 42 may open onto the side surfaces 22, 24.

The lockout apparatus 10 further comprises locking means generally indicated at 46 (FIG. 4). The locking means 46 is disposed within the first bore 36 and is movable in advancing and retracting fashion along the axis 36A thereof. In the preferred case the locking means 46 takes the form of a threaded locking pin 48 having a first end 48A and a second end 46B thereon. The first end 48A of the pin 48 has a slot 48S therein. The pin 48 is thereby manipulable using a suitable implement (e.g., a screwdriver) insertable through the bore 36 from the active surface 18 of the body 12.

In connection with a second embodiment of the invention the body 12 has a second channel 54 formed therein. The second channel 54 has an axis 54A associated therewith. In the preferred implementation the second channel 54 takes the form of an enclosed passage that opens onto the abutment surface 14 and extends a second predetermined distance 56 (measured along its axis 54A) into the body 12. The second distance 56 is preferably slightly greater than the distance 29. The first bore 36 passes completely through the second channel 54. Preferably the axis 54A of the second channel 54 lies in parallel relationship with and is spaced a predetermined distance 58 from the first channel 28. Thus the axis 54A of the second channel 54 also intersects the axis 36A of the bore 36 at a right angle.

The second channel 54 has a predetermined height dimension 54H associated therewith. The height dimension 54H is measured along the axis 36A of the bore 36. The second channel 54 is sized to accept a second projecting portion of an electrical device, as will be explained more fully hereinafter. It is noted that if the lockout apparatus 10 is provided with both a first channel 28 and a second channel 54 arranged as shown, then, for greatest flexibility of use, the length dimension of the locking pin 48 should be at least slightly greater than the height dimension 54H of the second channel 54.

Figure 5:
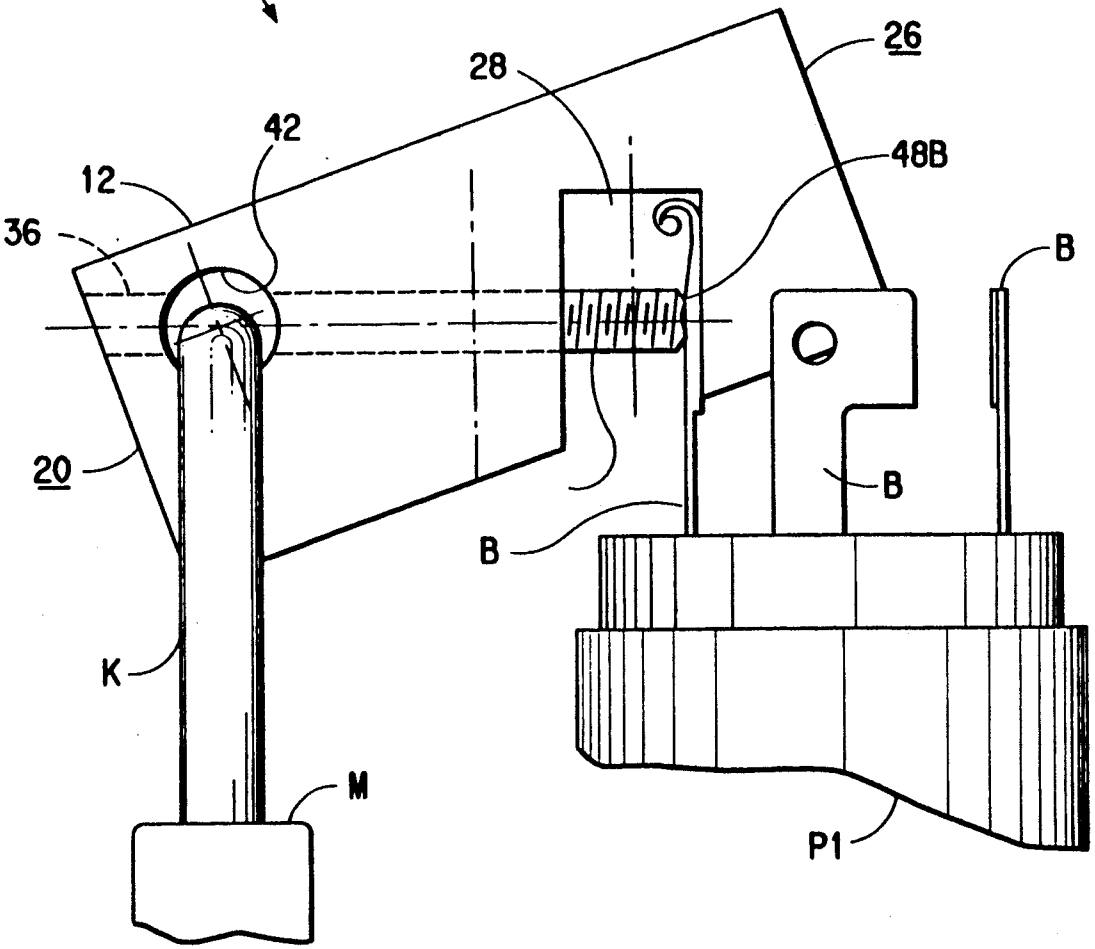
FIG. 5 is a side elevational view in which the apparatus of the present invention is shown in use with a switch having at least one arcuate power blade.
Figure 7:
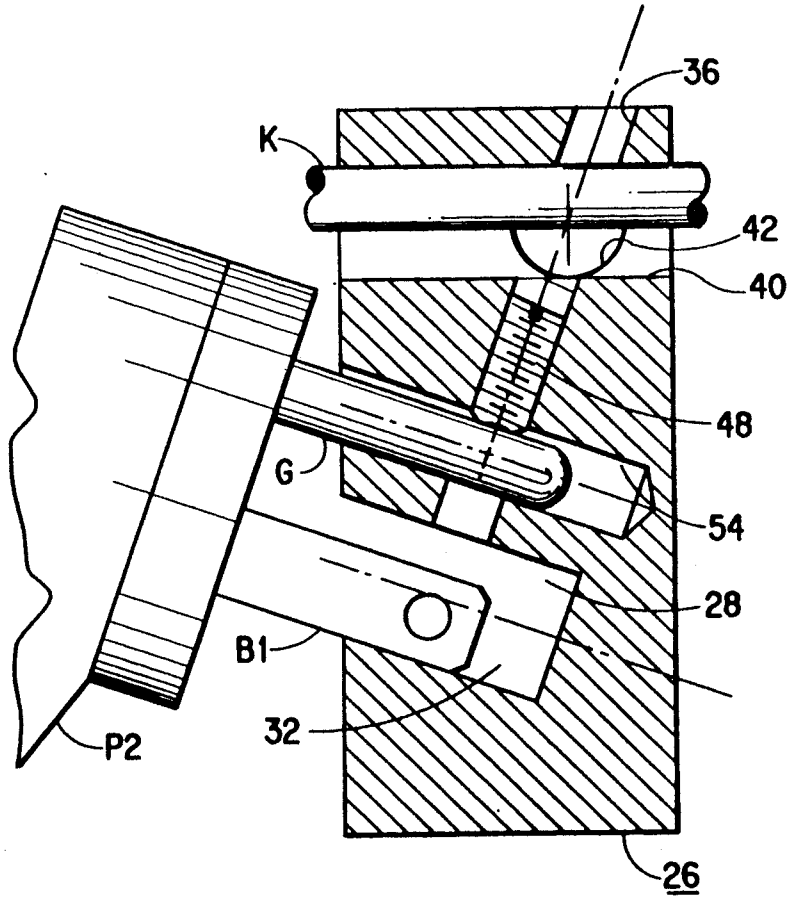
FIG. 7 is also a sectional view similar to that of FIG. 4 in which the apparatus of the present invention is shown in use with a plug of the type having a pair of power blades and a grounding blade.
Figure 6:
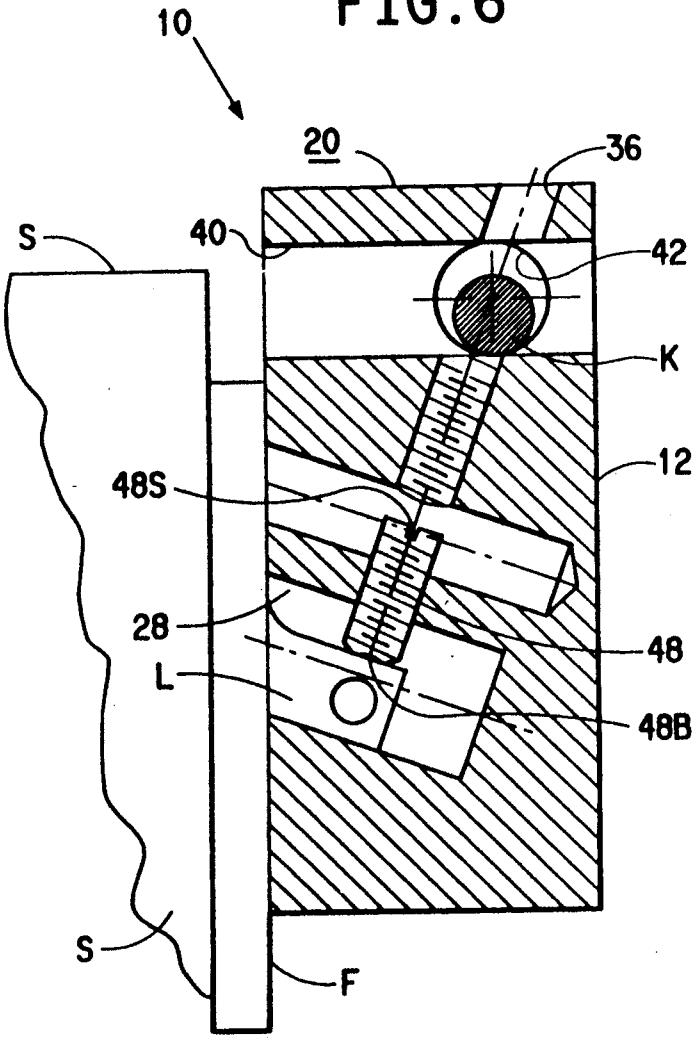
FIG. 6 is a sectional view generally similar to that shown in FIG. 4 in which the apparatus of the present invention is shown in use with a switch having an actuating lever.

Having defined the structure of the lockout apparatus 10 in accordance with various embodiments of the present invention the use thereof in preventing access and use of various types of electrical devices may be discerned from FIGS. 5 through 7.

In FIG. 5 the lockout apparatus 10 is shown in use with an electrical device of the type having a plug P1 with a plurality of arcuate blades B projecting therefrom. In FIG. 6 the lockout apparatus 10 is shown in use with an electrical device having an actuating lever L projecting forwardly from the planar face plate F of the housing thereof. The electrical device may, for example, be a circuit breaker or any standard wall mounted switchplate arrangement, either of which is illustrated by the character S. For the use shown in FIG. 5 an embodiment of the lockout apparatus 10 having only the first channel 28, the first bore 36 and one of the bores 40, 42 finds particular utility. In the use illustrated in FIG. 6 the body 12 is seen to contain both the second bore 40 and the third bore 42. As should be apparent an embodiment of the lockout apparatus that also includes the second channel 54 may be used with advantage in situations such as those illustrated in FIGS. 5 and 6.

As seen in FIGS. 5 and 6 the projecting portion of the electrical device, whether defined by one of the arcuate blades B of the plug P1 or the lever L of the breaker S, is received in the first channel 28. The locking pin 48 is advanced within the first bore 36 by inserting an implement, such as a screwdriver, into the bore 36 from the active surface 20 of the body 12. The pin 48 is advanced until the second end 48B thereof engages the blade B (FIG. 5) or the lever L (FIG. 6), as the case may be, and wedges the same against the portion of the body 12 defining a wall of the channel 28.

The structure of the lockout apparatus 10 in accordance with the resent invention contemplates that a convenient one of the bores 40, 42 may accept an access prevention member, such as the lockbar K of a lock M, whereby access to the slot 48S on the locking pin 48 in the bore 36 is precluded. Thus, retraction of the locking pin 48 is effectively prevented. It should be apparent, therefore, that use of the locking apparatus 10 in accordance with the teachings of the present invention effectively satisfies the requirements of the relevant OSHA regulations.

In the case of the plug P1 having the arcuate blade B (FIG. 5) insertion of the plug P1 into an outlet is precluded by the presence of the lockout apparatus 10. Similarly, in the case of the actuating lever L (FIG. 6) it is noted that actuation of the lever L is precluded by the abutting engagement of the abutment surface 14 on the body 12 (along, at least, the line of contact 16 thereon) with the face plate F of the switch S.

FIG. 7 illustrates the use of the lockout apparatus 10 in connection with an electrical device having a plug P2 that includes a pair of power blades B1 and B2 and a grounding blade G. Only the blade B1 is visible in FIG. 7. For such a use only the embodiment of the lockout apparatus having at least the first channel 28, the second channel 54, the first bore 36 and (at least) one of the second bore 40 or the third bore 42 has utility. In use the projecting grounding blade G is inserted into the second channel 54 in the body 12 while the projecting power blades B1 and B2 are simultaneously received within the first channel 28 in the body 12.

The lockout device 10 is secured to the plug P2 by advancing the locking pin 48 within the first bore 36 so that the same projects into the second passage 54 where it secures the grounding blade G against the body 12. When so secured the plug P2 is unable to be inserted into an electrical outlet. Abutting contact between the abutment surface 14 and the body of the plug P2 may or may not be effected, depending upon the configuration of the plug and the length of the blades thereof. However, as is manifest from FIG. 7, with the lockout device secured to the grounding terminal G insertion of the plug P2 into an electrical outlet is nevertheless precluded. In the instance shown in FIG. 7 the lockbar K is received in a convenient one of the bores 40, 42 and prevents access to the pin 48 whereby the lockout apparatus 10 may be removed.

Those skilled in the art having the benefit of the teachings of the present invention as hereinabove set forth may effect numerous modifications thereto. For example, although the body 12 is shown as substantially rectanguloid in configuration, such is not necessarily the case. The body 12 may take any convenient configuration so long as at least one line of abutment is defined on the body 12 if the apparatus 10 is desired for use as a lockout apparatus for a device having a lever projecting from a faceplate. Alternatively the presence of an abutment surface (or a line of abutting contact) is not necessary if the desired end use of the lockout device is to inhibit the insertion of the plug into a power outlet. Moreover, as noted earlier, the location and orientation of one or more bore(s) 40, 42 may be defined in any convenient fashion. These and other modifications are to be construed as lying within the contemplation of the present invention as defined by the appended claims.

What is claimed is:

1. Apparatus for preventing the use of an electrical device that includes an electrical plug having a pair of power blades and a grounding blade, the apparatus comprising:

a body, the body having a first and a second channel formed therein, the first channel being spaced a predetermined distance from the second channel, the body having a first bore that intersects both the first and second channels extending therethrough, the spacing between the first and second channels being such that a pair of power blades of a plug and a grounding blade thereof are respectively simultaneously receivable within the first channel and the second channel; and locking means disposed within the first bore and advanceable therethrough into locking engagement with a grounding blade disposed in the second channel.

2. The apparatus of claim 1 wherein the first bore is threaded, wherein the second channel has a predetermined height dimension associated therewith, and wherein the locking means comprises a threaded locking pin, the locking pin having a first and a second end, the first end of the locking pin having a slot for receiving an implement for threadably advancing the locking pin within the first bore, the locking pin having a length dimension greater than the height dimension of the second channel.

3. The apparatus of claim 1 wherein the body further comprises a second bore intersecting the first bore, the second bore being sized for receipt of an access prevention member therein.

4. The apparatus of claim 3 wherein the first bore is threaded, wherein the second channel has a predetermined height dimension associated therewith, and wherein the locking means comprises a threaded locking pin, the locking pin having a first and a second end, the first end of the locking pin having a slot for receiving an implement for threadably advancing the locking pin within the first bore, the locking pin having a length dimension greater than the height dimension of the second channel.

5. Apparatus for preventing the use of an electrical device that includes an electrical plug having at least one arcuate blade, the apparatus comprising:

a body having a channel formed therein and having a first bore that intersects the channel extending therethrough, the channel being sized to receive an arcuate blade of a plug, the body having a second bore intersecting the first bore, the first bore and the second bore each having an axis therethrough, the axis of the first bore defining a predetermined angle with respect to the axis of the second bore, the second bore being sized for receipt of an access prevention member therein; and locking means disposed within the first bore and advanceable therethrough into locking engagement with an arcuate blade of a plug disposed in the channel.

6. The apparatus of claim 5 wherein the first bore is threaded and wherein the locking means comprises a threaded locking pin, the locking pin having a first and a second end, the first end of the locking pin having a slot for receiving an implement for threadably advancing the locking pin within the first bore.

7. Apparatus for preventing the use of an electrical device that includes a switch having an operating lever extending from a face plate, the lever being rotatable from a first to a second position, the apparatus comprising:

a body having a channel formed therein and having a first bore that intersects the channel extending therethrough, the channel being sized to receive an actuating lever of a switch, the body having an abutment surface having at least a line of contact defined thereon, the channel opening onto the abutment surface, the body having a second bore intersecting the first bore, the second bore being sized for receipt of an access prevention member therein; and locking means disposed within the first bore and advanceable therethrough into locking engagement with a lever of a switch received in the channel such that rotation of the lever throughout a range of arcuate motion sufficient to change the state of a switch is precluded by abutting interaction along at least the line of contact between the abutment surface and a face plate of the switch.

8. The apparatus of claim 7 wherein the first bore is threaded and wherein the locking means comprises a threaded locking pin, the locking pin having a first and a second end, the first end of the locking pin having a slot for receiving an implement for threadably advancing the locking pin within the first bore.

9. The apparatus of claim 7 wherein the body is substantially rectanguloid in shape and wherein the abutment surface is planar.

10. Apparatus for preventing the use of an electrical device having at least a first projecting portion thereon, the apparatus comprising:

a body having at least a first channel formed therein and having a first bore extending therethrough, the first bore intersecting the channel, the channel being sized to receive a first projecting portion of an electrical device, the body having a second bore therein, the second bore intersecting the first bore, the first bore and the second bore each having an axis therethrough, the axis of the first bore defining a predetermined angle with respect to the axis of the second bore; and locking means disposed within the first bore and advanceable therethrough into locking engagement with a first projecting portion of an electrical device disposed within the channel.

11. The apparatus of claim 10 wherein the first bore is threaded and wherein the locking means comprises a threaded lock pin, the locking pin having a first and a second end, the first end of the locking pin having a slot for receiving an implement whereby the locking pin is threadably advanceable within the first bore.

12. The apparatus of claim 10 wherein the channel has an axis therethrough and wherein the body has a surface having at least a line of contact thereon, the channel communicating with the surface, the line of contact defining a predetermined angle with respect to the axis of the channel.

13. The apparatus of claim 12 wherein the first bore is threaded and wherein the locking means comprises a threaded lock pin, the locking pin having a first and a second end, the first end of the locking pin having a slot for receiving an implement whereby the locking pin is threadably advanceable within the first bore.

14. The apparatus of claim 10 wherein the electrical device has a second projecting portion thereon, and wherein the body has a second channel formed therein, the second channel being spaced a predetermined distance from the first channel, the second channel having an axis therethrough, the second channel being sized to receive a second projecting portion of an electrical device, the bore intersecting both the first and the second channels.

15. The apparatus of claim 14 wherein the first bore is threaded, wherein the second channel has a predetermined height dimension associated therewith, and wherein the locking means comprises a threaded lock pin, the locking pin having a first and a second end, the first end of the locking pin having a slot for receiving an implement whereby the locking pin is threadably advanceable within the first bore, the locking pin having a length dimension greater than the height dimension of the second channel.

16. The apparatus of claim 14 wherein the first and second channels and the first bore each have an axis extending therethrough, the axes of the channels being parallel to each other and the axes of the channels being perpendicular to the axis of the first bore.

17. The apparatus of claim 16 wherein the body has a surface having at least a line of contact thereon, the first and second channels communicating with the surface with the line of contact defining a predetermined angle with respect to the axes of the channels.

18. The apparatus of claim 16 wherein the first bore is threaded, wherein the second channel has a predetermined height dimension associated therewith, and wherein the locking means comprises a threaded lock pin, the locking pin having a first and a second end, the first end of the locking pin having a slot for receiving an implement whereby the locking pin is threadably advanceable within the first bore, the locking pin having a length dimension greater than the height dimension of the second channel.

* * * * *